United States Patent [19]

Cheek

[11] Patent Number: 5,054,580

[45] Date of Patent: Oct. 8, 1991

[54] MODULAR WALKWAY SYSTEM

[76] Inventor: William B. Cheek, 11504 Golden Gate Dr., Yucaipa, Calif. 92399

[21] Appl. No.: 587,342

[22] Filed: Sep. 24, 1990

[51] Int. Cl.[5] ..... E04G 21/32

[52] U.S. Cl. ..... 182/179; 182/151; 182/152

[58] Field of Search ..... 182/179, 178, 152, 151

[56] References Cited

U.S. PATENT DOCUMENTS

| | | | |
|---|---|---|---|
| 1,746,027 | 2/1930 | Cannon | 182/179 |
| 3,382,949 | 4/1968 | Bloch | 182/113 |
| 3,566,991 | 3/1971 | Proulx | 182/179 |
| 4,222,459 | 9/1980 | Hard | 182/179 |
| 4,972,924 | 11/1990 | Nielsen | 182/179 |

*Primary Examiner*—Reinaldo P. Machado
*Attorney, Agent, or Firm*—Sheldon & Mak

[57] ABSTRACT

Disclosed is a modular walkway for elevated access to building structures, and for protectively covering sidewalks adjacent to such structures, including a plurality of canopy modules that are connected end-to-end when erected, and nestedly stackable for compact storage. Each of the canopy modules has a wall structure and a roof walkway cantilevered thereto. a face structure being movably connected to an edge extremity of the walkway. In an erected configuration, each module is supported by adjustable feet at the bottom of the wall structure, and a pair of columns that support opposite ends of the face structure, the face structure extending vertically above and below the walkway and strengthening the walkway. The face structure is foldable substantially into the plane of the walkway for providing a convenient and compact nested configuration of the modules when stacked.

11 Claims, 1 Drawing Sheet

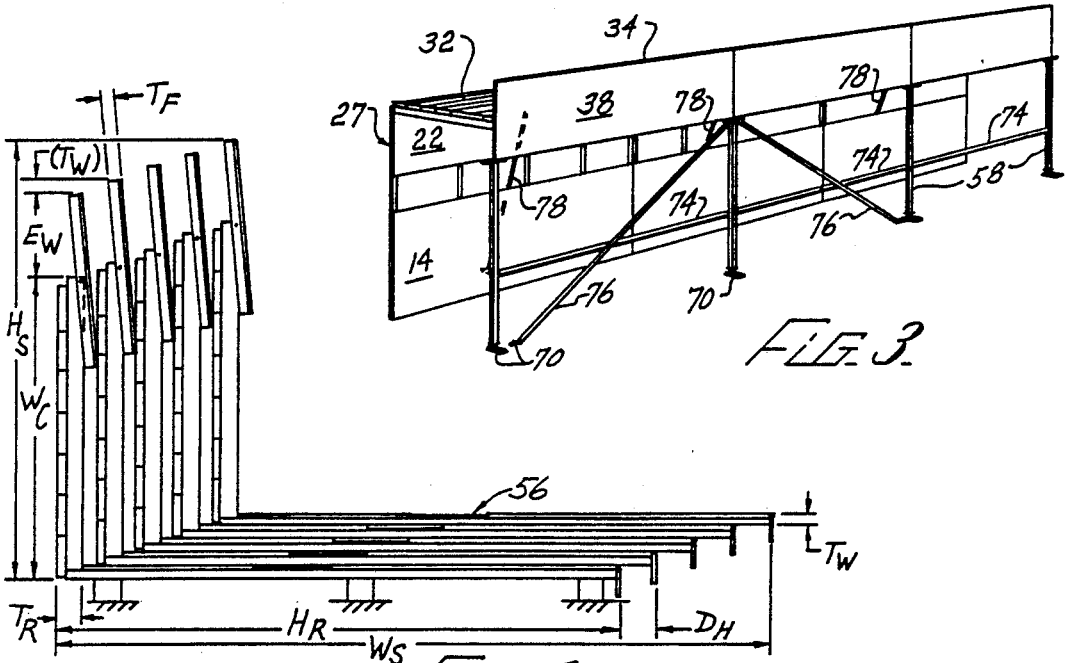
FIG. 3
FIG. 4
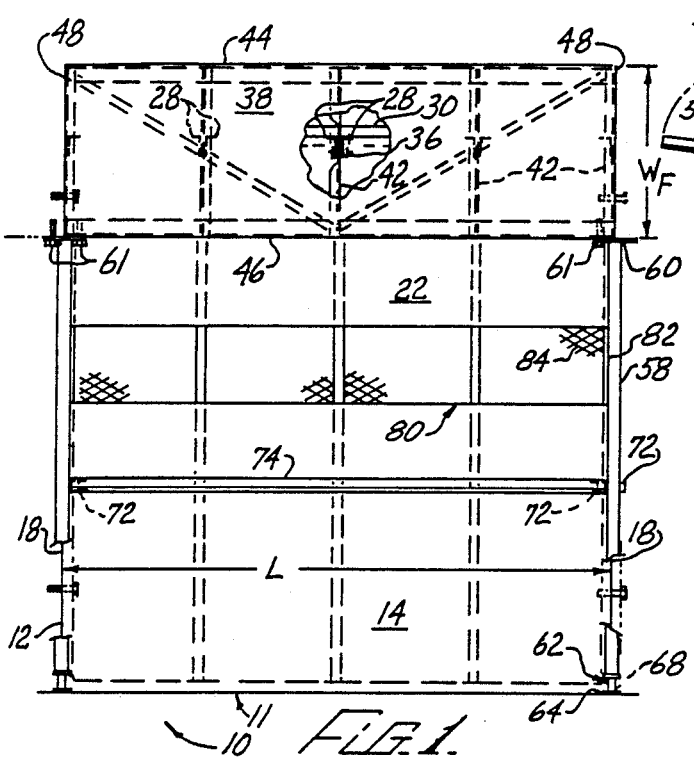
FIG. 1
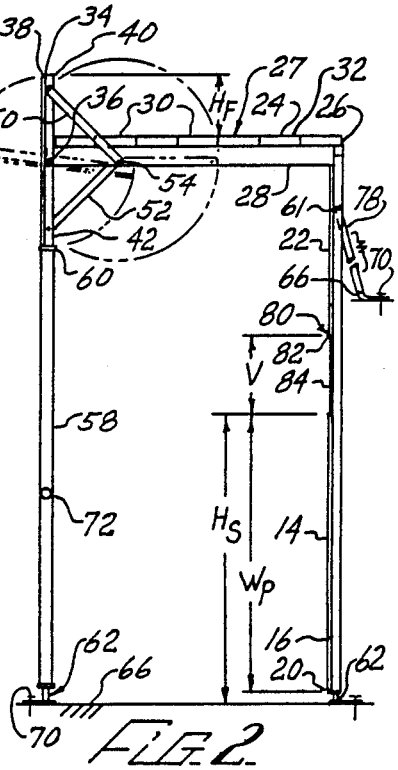
FIG. 2

MODULAR WALKWAY SYSTEM

BACKGROUND

The present invention relates to safety structures used during building construction, and more particularly to such structures providing an elevated walkway and/or protective covering for a sidewalk or the like.

Sidewalks adjacent to tall buildings under construction or during remodeling are typically provided with a bridge-type scaffold structure for protecting passers-by from falling objects, the structure also providing an elevated walkway above the sidewalk for workers on the job. One conventional form of such structures employs in-place fabrication from posts, beams, braces, etc. Typical modular forms of similar prior art structures are disclosed in U.S. Pat. Nos. 1,746,027 to Cannon, 3,382,949 to Block, and 3,566,991 to Prouly. A number of disadvantages are exhibited in each of the above examples, including one or more of the following:

1. They are excessively time-consuming to fabricate and dismantle;
2. They are difficult to transport and store in they are excessively bulky, even when dismantled;
3. They are difficult to use in that they do not preserve convenient lines of sight for use such as by surveyors of the work in process;
4. They are unsightly; and
5. They are excessively expensive to provide in that they include intricate custom components and fittings.

Thus there is a need for modular walkway system that overcomes the above disadvantages.

SUMMARY

The present invention is directed to a system that meets this need. At least one module of the system includes a rectangular wall structure having a top, bottom, and sides; a rectangular roof structure rigidly joined perpendicular to the wall structure proximate the top thereof and having a roof extremity that extends parallel to the wall structure. A rectangular face structure is connected to the roof structure proximate the roof extremity, the roof structure, the wall structure, and the face structure having a common length, the module having means for holding the face structure perpendicular to the roof structure for strengthening the roof structure, and support means spaced from the wall structure for supporting the roof extremity with the roof structure elevated above a supporting surface and the wall structure extending vertically from the supporting surface. The face structure can be pivotally connected to the roof structure on a pivot axis, the holding means releasably locking the face structure perpendicular to the roof structure.

Preferably a quantity N of the modules is restable within a rest volume, the volume having a length approximately equal to the common length of the modules, and a width not greater than approximately a roof height of the roof structure from the supporting surface plus $(N-1)$ times a roof thickness of the roof structure, plus N times a face thickness of the face structure. The volume can also have a height not greater than approximately a roof width of the roof structure plus a face width portion of the face structure, plus N times the wall thickness. The pivot axis can be located approximately midway within the face height, the portion of the face width being approximately half of the face width.

The support means can include a pair of column members vertically extending below opposite end extremities of the face structure. The face structures can be removably connected to a top flange portion of a single column member. Each of the column members can have a pair of rail bosses extend from opposite sides thereof, a tubular hand rail member extending between the column members and being supported by end engagement with facing ones of the rail bosses. The wall structure preferably includes a rigid open frame having panel members vertically spaced apart thereon for providing a horizontally disposed view aperture through substantially a full width of the wall structure, whereby surveying operations may be performed between locations on opposite sides of the wall structure.

DRAWINGS

These and other features, aspects, and advantages of the present invention will become better understood with reference to the following description, appended claims, and accompanying drawings, where:

FIG. 1 is a front elevational view of one module of an erected modular safety walkway apparatus according to the present invention;

FIG. 2 is a right side elevational view of the apparatus of FIG. 1;

FIG. 3 is an oblique elevational perspective view showing series connected modules of the apparatus of FIG. 1; and FIG. 4 is left side elevational view showing a nested stacked plurality of the modules of FIG. 1.

DESCRIPTION

The present invention is directed to a modular walkway for elevated access to building structures, and for protectively covering sidewalks adjacent to such structure With reference to FIGS. 1–4 of the drawings, a walkway system 10 according to the present invention includes a canopy module 11, a plurality of the modules 11 to be connected end-to-end as described below. Each of the canopy modules 11 has a rigid, planar frame wall structure portion 12 having a length L and a height $H_w$. A lower panel member 14 having a panel width $W_p$ is rigidly connected to a front face surface 16 of the structure portion 12, the panel member 14 extending to a length L that is flush with opposite side edge extremities 18, and to a bottom edge extremity 20 of the structure portion 12. An upper panel member 22 is similarly connected to the structure portion 12 and vertically spaced above the lower panel member 14 by a distance V, the upper panel member 22 also extending to the length L between the side edge extremities 18.

A rectangular roof structure portion 24 is rigidly connected perpendicular to the wall structure portion 12 proximate a top edge extremity 26 of the wall structure portion 12, the structure portions 12 and 24 forming an inverted L-shaped canopy section 27. The roof structure portion 24 includes a spaced plurality of structural joist members 28 that are rigidly connected to the wall structure portion 12, the joist members 28 supportively carrying a plurality of roof stringer members 30 for providing a roof walkway surface 32, each of the stringer members 30 preferably having a length that is substantially the same as the length L of the wall structure portion 12. Typically, the stringer members 30 can be standard 2×8 planks of lumber. As best shown in FIG. 1, the joist members 28 are configured as inverted L-shaped members, being located in outwardly facing, closely spaced pairs.

A face structure 34 is pivotally connected to the roof structure portion 24 on a face pivot axis 36 that is located proximate the free ends of the joist members 28. The face structure 34 includes a face panel member 38 that is rigidly connected to a rectangular face frame 40 having a face width $W_F$ and a length substantially the same as the length L of the wall structure portion 12. The face frame 40 includes a parallel-spaced plurality of L-shaped rib members 42, the frame 40 having a top edge extremity 44, a bottom edge extremity 46, and a pair of side edge extremities 48.

In a preferred configuration of the module 10, the face pivot axis 36 is located proximately midway between the top and bottom extremities 44 and 46 of the face structure 34. The face structure 34 has an erected position relative to the roof structure 24 as indicated by the solid lines is FIG. 2, each of the rib members 42 extending between a pair of the joist members 28, being pivotally connected thereto on the face pivot axis 36. A spaced plurality of upper fare braces 50 and lower face braces 52 are also pivotally connected to respective ones of the roof joist members 28 on a common brace axis 54 for holding the face structure 34 in its erected position. In the erected position, each of the upper face braces 50 is removably connected to one of the rib members 42 proximate an upper extremity thereof, and each of the lower face braces 52 is similarly connected to one of the rib members 42 near a lower extremity thereof for securely locking the face structure 34 in the erected position.

As further shown by the dashed lines in FIG. 2, the face structure 34 is movable to a storage position proximately coplanar with the roof stringer members 30, whereby a plurality of the canopy modules 11 are storable in a preferred configuration as a nested stack 56 of the modules 11 as shown in FIG. 4. Once the upper and lower face braces 50 and 52 are disconnected from the face structure 34, they are foldable beside the joist members 2 at which position they do not interfere with the stacking and unstacking of the modules 11. In the configuration of FIG. 4, the stack 56 occupies a compact volume having the length L (perpendicular to the view plane), a stack height $H_s$ (discussed below), and a stack width $W_s$ that is not greater than a roof height $H_R$ from the bottom of the canopy section 27 to the walkway surface 32 plus N−1 times a horizontal offset distance $D_H$ of not more than a roof thickness $T_R$ of the roof structure portion from the walkway surface 32 added to a face thickness $T_F$ of the face structure 34, where N is the total number of the modules 11 in the stack 56. This result is obtained by having the to edge extremity 44 of the face structure folded below the plane of the walkway surface 32 in the storage position as shown in FIG. 2. For this purpose, the face pivot axis 36 is located proximate the bottoms of the joist members 28 as best shown in FIG. 2. Alternatively, should the face structure 34 be foldable only to the extent that it traverses the walkway surface by the face thickness $T_F$, the stack width $W_s$ is increased slightly to H plus N−1times $T_R$ plus N times $T_F$.

The stack height $H_s$ in the preferred configuration of the stack 56, from the back of the lowest wall structure portion 12 to the top edge extremity 44 of the highest face structure 34, is not greater than a canopy width $W_c$ of the canopy sections 27 from the back of the wall structure portion 12 to the free ends of the joist members 28 plus a face extension distance $E_w$ by which the face structure extends beyond the joist members 28 in the storage position, plus N−1 - times the wall thickness $T_w$ of the canopy sections 27 between the backs of the wall structure portions 12 and the fronts of the panel members 14 and 22.

A plurality of column members 58 are provided for supporting opposite ends of each face structure 34, each of the column members 58 having a top flange member 60 rigidly connected thereto for supporting and tying together an adjacent pair of the face structures 34 by suitable face fasteners 61 that protrude opposite ends of the flange member 60, threadingly engaging each face frame 40. Counterparts of the face fasteners 61 are also used for securing together the side extremities of adjacent wall structure portions, as shown in FIG. 1. Each of the column members 58 has an adjustable foot assembly 62 that threadingly engages a bottom end of the column member 58, the foot assembly 62 having a foot member 64 for resting on a supporting surface 66 on which the system 10 is erected. The foot member 64 has an anchor passage 68 for accepting a suitable anchor fastener 70, whereby the system 10 is also anchored to the supporting surface 66. Counterparts of the foot assembly 62 are also affixed to the wall structure portions 12 for anchoring same to the supporting surface 12.

A pair of rail bosses 72 are affixed to opposite sides of each column member 58, such as by welding, for locatively supporting a tubular hand rail member 74 below each of the face structures 34. As shown in FIG. 4, a complementary pair of shear or column braces 76 are provided for diagonally bracing the columns 58, each brace 76 being connected to the flange member 60 of one column member 58 by one of the face fasteners, a lower extremity of the brace 76 being anchored to the supporting surface 66 by a counterpart of the anchor fasteners 70. As further shown in FIGS. 2 and 4, a plurality of wall braces 78 are similarly fastened to the backs of each wall structure portion 12, sloping downwardly away from the canopy sections 27 and being anchored to the supporting surface 66 for stiffening the system 10 in a direction perpendicular to the wall structure portions 12.

As described above, the upper panel member 22 is spaced above the lower panel member 14 on the wall structure portion 12 by the distance V. As shown in the drawings, the wall structure portion 12 is preferably configured as an open frame, which can be fabricated from steel tubing of round or preferably square cross section. More preferably. it has been determined that sufficient strength is obtained using elongated members having an open square cross-sectional shape, approximately 1.5 inches on a side, formed from 14 gauge steel. The common length L of the canopy sections s 27 is approximately 8 feet for accommodating the lower panel member 14 as a standard 4×8′×κ″ sheet of plywood, the width $W_p$ thus being 48 inches. The bottom extremity 20 of the wall structure portions 12 is spaced slightly above the supporting surface 66 by the adjustable foot assemblies 62, the lower panel member 14 extending to a panel height $H_p$ of approximately 50 inches. The spacing V is approximately 15 inches in the preferred configuration, advantageously providing a field of view through the canopy sections 27 for use by surveyors and the like.

A protective screen assembly 80 is fastened to the wall structure portion 12 within the distance between the panel members 14 and 22, the screen assembly having a perimeter frame 82 and a screen panel 84, welded together. A suitable material for the screen panel 84 is conventional flat rolled "expanded metal" which has a multiplicity of openings formed in relatively stiff sheet metal such as 16 gauge steel.

In the preferred configuration of the canopy modules 11, the roof height $H_R$ between the supporting surface 66 and the walkway surface 32 is approximately 99 inches, the canopy width $W_c$ being approximately 52.25 inches. The face structure 34 extends above the walkway surface by an upper face extension $H_F$ of approximately 12 inches in the erected position, the face width $W_F$ being approximately 30 inches. Accordingly, the face extension distance $E_w$ in the storage position is approximately 14.5 inches. The wall thickness $T_w$ and the face thickness $T_F$ are each approximately 2.0 inches, and the roof thickness $T_R$ is approximately 4.5 inches, the horizontal offset distance $D_H$ being approximately 6.5 inches. Accordingly, the stack width $W_s$ of the nested stack 56 of FIG. 4 having N=5 of the canopy sections 27 is approximately 125 inches, the stack height $H_s$ being approximately 74.25 inches Although the present invention has been described in considerable detail with reference to certain preferred versions thereof, other versions are possible. For example, the face structure 34 can be movably connected to the canopy section 27 by a plurality of four-bar linkages or the like for reducing the distance $E_w$ in the storage position, the face structure 34 being lockable in its erected position by a plurality of removable pins or fasteners that connect the rib members 42 to the joist members 28. Also, the face structure 34 can be removably connected to the canopy section 27. Therefore, the spirit and scope of the appended claims should not necessarily be limited to the description of the preferred versions contained herein.

What is claimed is:

1. A modular walkway system, at least one module thereof comprising:

(a) a rectangular wall structure having a top, bottom, and sides;

(b) a rectangular roof structure rigidly joined perpendicular to the wall structure proximate the top thereof, and having a roof extremity that extends parallel to the wall structure;

(c) a rectangular face structure connected to the roof structure proximate the roof extremity and having a face width, the roof structure, the wall structure, and the face structure having a common length;

(d) means for holding the face structure perpendicular to the roof structure, the face structure strengthening the roof structure; and (e) support means spaced from the wall structure for supporting the roof extremity with the roof structure elevated above a supporting surface and the wall structure extending vertically from the supporting surface.

2. The system of claim 1, wherein the face structure is pivotally connected to the roof structure on a pivot axis, the holding means releasably locking the face structure perpendicular to the roof structure.

3. The apparatus of claim 2, wherein the roof structure has a roof thickness and a roof height from the supporting surface to a top surface of the roof structure, and the face structure has a face thickness, a quantity N of the modules being restable within a rest volume, the volume having a length approximately equal to the common length, and a width not greater than approximately the roof height plus (N−1) times the roof thickness plus N times the face thickness.

4. The apparatus of claim 3, wherein the width is not greater than the roof height plus (N−1) times the roof thickness plus (N−1) times the face thickness.

5. The apparatus of claim 3, wherein the volume also has a height not greater than approximately the roof width plus a portion of the face width, plus N times the wall thickness.

6. The apparatus of claim 5, wherein the pivot axis is located approximately midway within the face height, and the portion of the face width is approximately half of the face width.

7. The apparatus of claim 1, wherein the support means comprises a pair of column members vertically extending below opposite end extremities of the face structure.

8. The apparatus of claim 7, wherein the face structures of adjacent modules are removably connected to a top flange portion of a single column member.

9. The apparatus of claim 7, wherein each column member has a pair of rail bosses extending from opposite sides thereof, the system further comprising a tubular hand rail member extending between the column members and being supported by end engagement with facing ones of the rail bosses.

10. The apparatus of claim 1, wherein the wall structure comprises a rigid open frame having panel member vertically spaced apart thereon for providing a horizontally disposed view aperture through substantially a full width of the wall structure, whereby surveying operations may be performed between locations on opposite sides of the wall structure.

11. A modular walkway system, at least one module thereof comprising:

(a) a rectangular wall structure having a top, bottom, and sides;

(b) a rectangular roof structure rigidly joined perpendicular to the wall structure proximate the top thereof, and having a roof extremity that extends parallel to the wall structure, the roof structure having a roof thickness;

(c) a rectangular face structure pivotally connected to the roof structure on a pivot axis proximate the roof extremity and having a face width, the roof structure, the wall structure, and the face structure having a common length, the face structure having a face thickness;

(d) means for holding the face structure perpendicular to the roof structure, the holding means releasably locking the face structure perpendicular to the roof structure, the face structure strengthening the roof structure; and (e) support means spaced from the wall structure for supporting the roof extremity with the roof structure elevated above a supporting surface, and the wall structure extending vertically from the supporting surface, the roof structure having a roof height from the supporting surface to a top surface of the roof structure, whereby a quantity N of the modules being restable within a rest volume, the volume having a length approximately equal to the common length, a width not greater than approximately the roof height plus (N−1) times the roof thickness plus N times the face thickness, and a height not greater than approximately the roof width plus a portion of the face width, plus N times the wall thickness.

* * * * *